US006749437B2

(12) United States Patent
Chan

(10) Patent No.: US 6,749,437 B2
(45) Date of Patent: Jun. 15, 2004

(54) ELECTRONIC DISPLAY MATERIALS ASSOCIATED WITH PRODUCTS

(75) Inventor: Albert Wai Tai Chan, Taipei (TW)

(73) Assignee: Thinking Technology, Inc., Nassau (BS)

( * ) Notice: Subject to any disclaimer, the term of this patent is extended or adjusted under 35 U.S.C. 154(b) by 157 days.

(21) Appl. No.: 10/021,041

(22) Filed: Dec. 19, 2001

(65) Prior Publication Data

US 2002/0106624 A1 Aug. 8, 2002

Related U.S. Application Data

(60) Provisional application No. 60/268,701, filed on Feb. 15, 2001, and provisional application No. 60/265,899, filed on Feb. 5, 2001.

(51) Int. Cl.[7] ..... G09B 25/00; B65D 85/00

(52) U.S. Cl. ..... 434/393; 206/459.1; 206/459.5; 446/72; 446/73; 446/82; 446/268

(58) Field of Search ..... 434/393; 446/73, 446/75, 82, 268, 297, 81, 258, 295, 296, 385; 206/457, 459.1, 459.5, 776, 769, 778, 542; 362/154

(56) References Cited

U.S. PATENT DOCUMENTS 4,035,941 A * 7/1977 Deffner ..... 40/219
4,723,656 A * 2/1988 Kiernan et al. ..... 206/705
5,188,231 A * 2/1993 Kivell et al. ..... 206/705
5,289,916 A * 3/1994 Mickelberg ..... 206/756
5,465,909 A * 11/1995 Roth ..... 232/1 D
5,636,741 A * 6/1997 O'Keefe ..... 206/459.1
5,795,209 A * 8/1998 Moore ..... 446/73
5,905,429 A * 5/1999 Hornstein et al. ..... 340/384.6
5,919,074 A * 7/1999 Honda ..... 446/268
5,980,352 A * 11/1999 Rigberg ..... 446/73
6,084,526 A * 7/2000 Blotky et al. ..... 340/691.6
6,227,931 B1 * 5/2001 Shackelford ..... 446/268
6,319,087 B1 * 11/2001 Ferrigno ..... 446/297

* cited by examiner

*Primary Examiner*—Teresa Walberg
*Assistant Examiner*—Cameron Saadat
(74) *Attorney, Agent, or Firm*—Kramer & Amado, P.C.; Gordon J. Zimmerman, Esq.

(57) ABSTRACT

Innovative and improved display materials associated with products provide enhanced information to potential or actual purchasers of such products. In an aspect of the invention, electronic product packaging for demonstrative use in association with a product comprises demonstration means adapted to demonstrate visually or audibly the use or capabilities of the product under the control of integrated circuit means.

48 Claims, 13 Drawing Sheets

ELECTRONIC DISPLAY MATERIALS ASSOCIATED WITH PRODUCTS

This application claims the benefit of Provisional Appl. No. 60/268,701 filed Feb. 15, 2001 and Provisional Appl. No. 60/265,899 filed Feb. 5, 2001.

BACKGROUND TO THE INVENTION

There is a great deal of art in the packaging industry. Attractive packaging of products is a great aid to the sale of such products. Much packaging contains detailed written descriptions respecting the products contained within. In some cases, the product is well displayed. Very recently, electronic products have been displayed in packaging which allows the user to activate the product in the packaging to perform a brief demonstration of the product's use or capabilities. It would be a considerable advance in the art if the packaging itself could provide enhanced information to the user, either audibly or visually or by a combination of audible and visual stimuli. It would be a further advantage to extend such capabilities to display materials associated with products, other than traditional packaging.

SUMMARY OF THE INVENTION

Accordingly, in a major aspect of the invention, innovative and improved display materials associated with products provide enhanced information to potential or actual purchasers of a product. In an aspect of the invention, product packaging for demonstrative use in association with a product comprises demonstration means adapted to demonstrate the use or capabilities of the product, means to receive electrical power, and means to receive signals from integrated circuit means programmed to control the demonstration means, such that when electrical power and integrated circuit means signals are received, the demonstration means is activated.

In a further aspect of the invention, product packaging for demonstrative use of a product comprises a source of electrical power, integrated circuit means comprising programmed demonstration information, demonstration means associated with the packaging adapted to demonstrate the use or capabilities of the product, and switch means adapted to initiate activity of the integrated circuit means, such that when the switch means is activated, signals from the integrated circuit means activate and control the demonstration means.

In a further aspect, product packaging for demonstrative use of a product comprises a source of electrical power, integrated circuit means comprising pre-programmed sound segments relevant to the product, sound reproduction means to reproduce sound under the control of the integrated circuit means, and switch means to initiate activity of the integrated circuit means, such that when the switch means is activated, pre-programmed sound segments suitable to demonstrate the use or capabilities of the product are generated.

In a further aspect of the invention, product packaging for demonstrative use of a packaged product comprises: packaging adapted to hold a product; a source of electrical power; an integrated circuit chip comprising pre-programmed sound segments relevant to the product; sound reproduction means to reproduce sound under the control of the integrated circuit chip; and switch means located on the packaging to control the flow of electrical power to the integrated circuit chip; such that when a user activates the switch means, pre-programmed sound segments suitable to demonstrate the use or capabilities of the product are generated.

In further aspects of the invention:

(a) the product is a toy;

(b) the source of electrical power comprises an electrical storage battery;

(c) the battery is associated with the packaging;

(d) the battery is associated with the product;

(e) the integrated circuit chip is associated with the packaging;

(f) the integrated circuit chip is associated with the product;

(g) pre-programmed sound segments comprise human speech;

(h) the pre-programmed sound segments comprise sound effects;

(i) the means to reproduce sound comprises an audio speaker;

(j) the audio speaker is associated with the packaging;

(k) the audio speaker is associated with the product;

(l) the means to reproduce sound comprises multiple audio speakers;

(m) at least one audio speaker is associated with the packaging, and at least one other audio speaker is associated with the product;

(n) the switch means is adapted to be activated by a user's touch;

(o) the switch means is associated with a graphic representation of a use or capability of the product;

(p) the product packaging further comprises illumination means to illuminate the graphic representation when the switch means is activated;

(q) the switch means comprises multiple switches corresponding to multiple features of the product's use or capabilities;

(r) the packaging further comprises multiple graphic representations of uses or capabilities of the product associated with the multiple switches;

(s) the packaging further comprises illumination means, where the switch means is further adapted to initiate illumination of multiple graphic representations of uses or capabilities of the product by said illumination means.

In a further aspect, packaging for a toy comprises: means to hold and display the toy; an electrical storage battery; an integrated circuit chip comprising pre-programmed sound segments relevant to the toy; an audio speaker to reproduce said sound segments under the control of the integrated circuit chip; and switch means located on the packaging to initiate the flow of electrical power to the integrated circuit chip; such that when a user activates the switch means, the sound segments are audibly reproduced.

In a further aspect of the invention, a packaging and product combination comprises electrical power means to provide electrical power to the product and the packaging, integrated circuit means associated with the packaging programmed to control a visual display associated with the packaging, and switch means adapted to trigger the integrated circuit means to perform visual display commands to create the visual display associated with the packaging.

In a further aspect of the invention, the packaging and product combination comprises electrical power means to provide electrical power to the product and the packaging, integrated circuit means programmed to control a visual display associated with the packaging, and switch means adapted to trigger the integrated circuit means to perform visual display commands to create the visual display associated with the packaging.

In further aspects of this embodiment of the invention:

(a) the product comprises the integrated circuit means and the switch means and further comprises communication means to carry signals from the integrated circuit means to the packaging;

(b) the communication means comprises a physical electrical connection; and (c) the communication means comprises a wireless electromagnetic transmitter and wherein the packaging further comprises receiver means to receive signals from said transmitter.

In a further aspect of the invention a packaging and toy combination comprises: means associated with the packaging to hold and display the toy; electrical power means to provide electrical power to the toy and the packaging; integrated circuit means comprising pre-programmed sound segments; sound reproduction means associated with each of the packaging and the toy under the control of the integrated circuit means; and switch means located on the packaging to initiate the flow of electrical power to the integrated circuit chip means; such that when a user activates the switch means, the sound segments are reproduced sequentially by the sound reproduction means of each of the packaging and the toy.

In a further aspect of the invention, point of purchase or point of sale display material for demonstrative use in association with a product comprises: a source of electrical power; integrated circuit means comprising pre-programmed sound segments relevant to the product; sound reproduction means to reproduce sound under the control of the integrated circuit means; and switch means to initiate activity of the integrated circuit means; such that when the switch means is activated, pre-programmed sound segments suitable to demonstrate the use or capabilities of the product are generated.

In a further aspect of the invention, a two-component toy comprises: a first part comprising a doll, character figure, or action figure; a second part comprising a play-set to be used in association with said first part; said second part comprising a source of electrical power, integrated circuit means comprising pre-programmed sound segments relevant to the product, sound reproduction means to reproduce sound under the control of the integrated circuit means, switch means to initiate activity of the integrated circuit means, such that when the switch means is activated, pre-programmed sound segments suitable to demonstrate the use or capabilities of the first part in conjunction with the second part are generated.

In a further aspect of the invention, a two-component product comprises: a first part comprising a useful article; a second part comprising display means adapted to demonstrate uses or capabilities of the first part, and intended to remain generally associated with said first part; said second part comprising a source of electrical power, integrated circuit means comprising programmed sequences of audible or visual information relevant to the first part, demonstration means adapted to manifest the audible or visual information under control of the integrated circuit means, and switch means to initiate activity of the integrated circuit means.

Further aspects of the invention will become apparent from the following description.

BRIEF DESCRIPTION OF THE DRAWINGS

Illustrative embodiments of the invention are shown in the attached drawings in which.

(a)

(b)

(c)

(d)

(e)

(f)

(g)

(h)

(i)

(j)

DETAILED DESCRIPTION OF THE INVENTION

Figure 1:
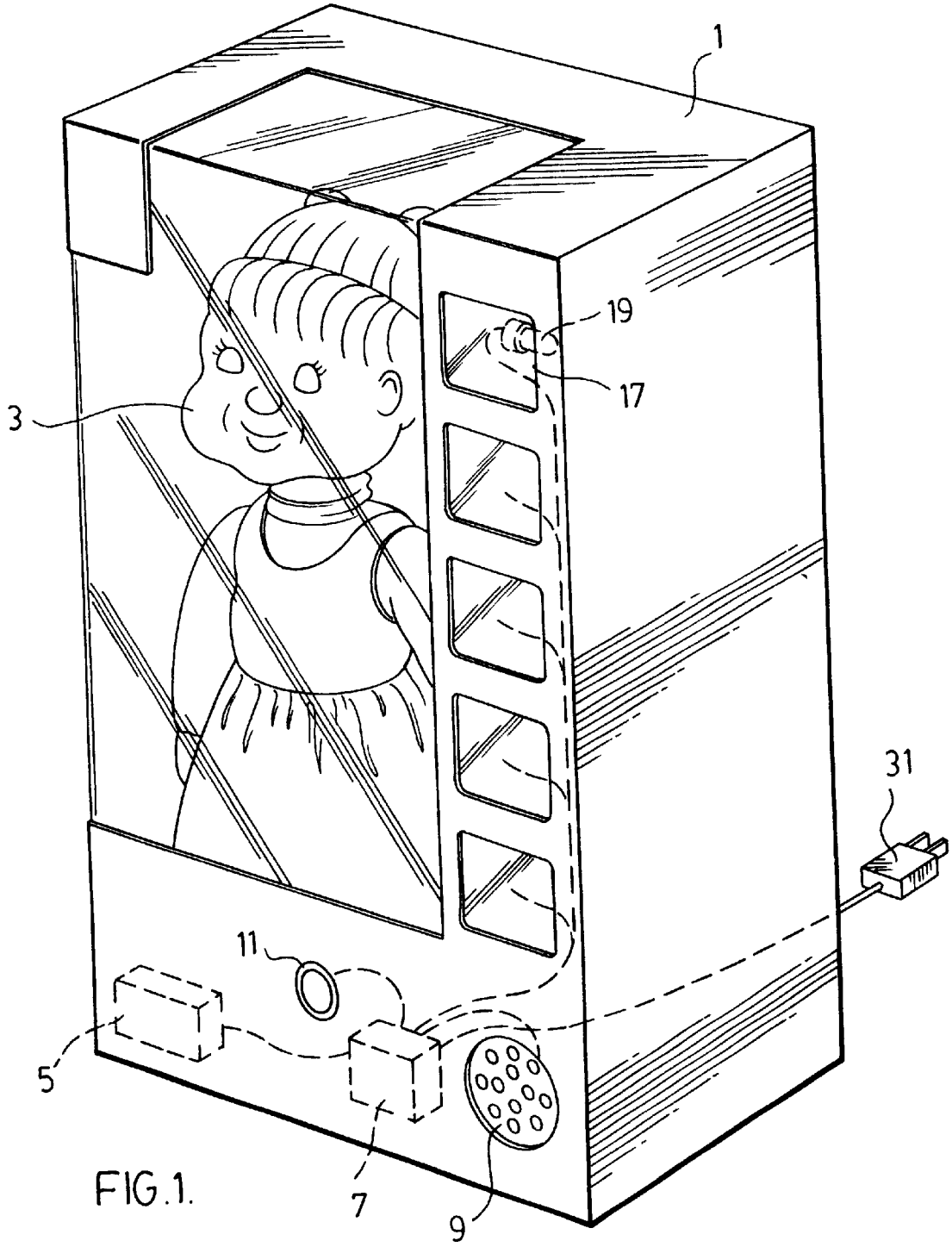
FIGS. 1 through 6 are perspective, schematic views of the components of the product and package combination in various arrangements.

Over the years, product packaging has developed in order to display products in interesting and effective ways. Most packaging is disposable, although, for some products, the packaging is retained and the product is stored in it. Packaging may be plain, or may bear graphics to identify the product and to demonstrate the capabilities of the product and its uses.

In accordance with the invention, enhanced packaging is provided. The packaging itself provides information about the product either visually, audibly, or by some combination of visible and audible means. The packaging may provide simple audible information, such as sound effects, recorded speech and the like concerning a few simple functions. When more computer memory, typically through the use of integrated circuit chips, is provided, the packaging can provide audible information equivalent to a story about a product, or a product manual. When detailed product information is provided on the package itself, there may be no need for a supplementary video tape or audio tape to provide information to a consumer. Indeed, the audible information provided along with graphics on packaging, may replace or at least supplement a written product manual.

From a marketing point of view, this enhanced packaging has great advantages. First, it provides information about the product, whether simple or detailed. Secondly, it attracts attention to the product through means of sounds and graphics. When illumination of various graphics is added to the packaging, a story can be created which almost appears animated. In an age of television, consumers will respond very favourably to receiving information in this way.

This packaging is useful both for products which have no capacity to create sound or images on their own, or in combination with products which are capable of producing sound, images or movement.

Such packaging requires some means to activate the demonstration means. Typically, activation will occur when a consumer or user touches a pushbutton or touch sensitive control to initiate the packaging activity. Other initiation mechanisms are also possible, however, such as motion detectors, vibration detectors, heat sensors, or electromagnetic sensors to detect changes in electrical capacitance caused by the approach of a body, or to receive infrared, radio, or other electromagnetic signals from some remote control unit.

Such packaging is applicable to consumer products such as sewing machines, electric drills, household appliances, and the like, as well as to toys, games, and other products. Any product of sufficient value to justify the cost of such demonstration means incorporated into the packaging will benefit from the use of such packaging.

Typically, the packaging itself will contain one or more integrated circuit chips to control the sound, light, or movement in the packaging which comprises the demonstration means. Self-contained power will typically be provided by electrical storage batteries.

Other alternatives are, however, possible. For example, the packaging may be provided with means to receive power, or signals from an integrated circuit, remotely. The packaging may draw on a power source located within the product, or signals from an integrated circuit chip located within the product, in order to perform its functions. A hard connection, such as by wires or fiberoptic cables, may carry such power and signals. Alternatively, a wireless means to deliver either the power or the signals, or both, may be provided, in which case the power and/or signals are conducted by electromagnetic means to the packaging.

Particularly if the packaging is intended to be used and reused as a manual for the product, or a play set for a toy, it may make sense to provide a connection to a source of stable alternating current from, for example, a wall socket. In this way, the packaging can be used to perform its functions long after purchase of the product simply by connecting to easily available household electrical current. When the source of such household power to the packaging also can be used to recharge batteries within the product, the use of such external power will be very convenient.

By using an appropriate switch, or transformers, rectifiers, transistors, or other electronic components, packaging which runs on battery power in-store prior to sale can be converted to run on normal household alternating current after purchase.

When the demonstration means comprises graphics printed on packaging, some sort of illumination will typically be provided to highlight different areas of the packaging in order to tell a story or provide information in an interesting or organized fashion. Alternatively, the packaging will provide only audible information to inform a purchaser or potential purchaser about the product. The ideal combination, however, involves use of both audible and visual stimulation to achieve the greatest effect and to provide a greater amount of information about the product.

In a particular embodiment of the invention, a point of purchase display is provided wherein the display which provides information about the product is physically separated from the product so that it does not actually constitute packaging. The same concepts, however, apply. In other words, the point of purchase display is provided with integrated circuit means to control some demonstration means, which may be visual, audible, or some combination of these.

In an alternative embodiment of the invention, product packaging of the kind described herein is provided for only a limited number of the products in question. These packages serve as point of purchase displays. Other products bear more traditional packaging without the special features of the packaging of the invention. If one such package of the invention ceases to function, owing to loss of power or some other malfunction, then another package of the invention can be used to take its place. This has an advantage over typical point of purchase displays which are not nearly so easy to replace. Packaging costs are reduced in such an arrangement, since only enough packages required to demonstrate the total number of products for sale need to be provided.

In the field of toys, certain toys already have "try me" features. In these circumstances, the triggering of a switch on the toy initiates a sequence of activities of which the toy is capable of performing. In an alternative embodiment of the invention, the "try me" features of the toy can be coordinated with the packaging in order to create a more detailed and interesting presentation. For example, the integrated circuit of the toy can be used to control both the toy and the packaging functions. Power from the toy can supply both the toy and the packaging so, for example, the toy can speak and perform certain actions while the packaging illuminates certain graphics illustrating particular activities or functions of the toy.

The visual stimulation means can be varied. For example, rather than using fixed graphics in fixed locations on the packaging, images may be rotated through an opening, or a series of openings, in the packaging by means of a motor drive. In this way, movement on the surface of the packaging can be created without the need for illumination of multiple panels of graphics.

Another embodiment involves the use of lenticulate technology. In this embodiment, a lens over a fixed graphic creates an apparent moving image when the graphic is rotated across the field of view of a user of the package. The lens effectively articulates movements by highlighting in sequence individual images on a two-dimensional graphic display. Alternatively, hologram or holograph images may be suitably employed so that movement of the package by the user, perhaps under the direction of audible instructions from the package, can create interest, simulated movement on the package surface, and the provision of information.

In a further embodiment, the product and its packaging may be used independently. Although the product and packaging will normally be provided to the consumer together, the packaging may be used separately from the product to provide continuing information. This is particularly applicable when the packaging is used as a sort of product manual.

In a further alternative, images stored in computer memory associated with the packaging can be converted to video images on a suitable screen. Although this application is currently very expensive, it may be appropriate for certain products where the packaging is to continue to be used as a source of information. In this embodiment, animated action equivalent to television can be created with or without voice or other sound information synchronized to the video display.

In a further aspect of the invention, the "packaging" can be reduced to a piece of point of sale material, such as a hang tag or card insert. For example, a very thin card with its own power source, sound, and illumination means can be attached to a product so that the consumer can obtain information about the product prior to purchase. Given the small dimensions of such cards, they would typically have a fairly short lifetime, but certainly long enough to perform their required functions. In a card which can be as thin as four or five millimeters, or even thinner, a small battery, an integrated circuit chip, micro speakers, and lights can be incorporated. Such cards may be used as novelties when removed from the product, or even when left in association with the product.

In yet a further embodiment, the packaging becomes part of the product. In other words, a portion of the product is devoted to providing information about the product, its capabilities or uses. A typical example of this is in the realm of toys where a portion of the product, which can also serve as packaging in which the product is sold, is intended to be used continually as part of the toy. For example, a play set which could be a stage, fashion runway, toy automobile, dollhouse, castle, or any of a myriad of possible play sets, can be sold along with a doll or other action figure to provide a permanent portion or element of the toy which can provide sound and/or light effects.

In typical operation, a switch on the packaging can be activated to cause audible information respecting the packaged product to be produced. In more sophisticated packaging, graphic representations on the packaging can be associated with a switch, or multiple switches, so that a particular use or capability of the product can be highlighted both graphically on the package and audibly by means of a pre-recorded voice description. Other sound effects may also be apt. As an added feature, the graphic representations can be illuminated when the appropriate switch is activated in order to further highlight the feature or features of the product being discussed.

Highly sophisticated packaging and product combinations can be produced. For example, in the case of a packaged electronic toy, both the packaging and the toy can be made to emit sounds which may correspond to speech or other sound effects. By pressing a button on the packaging to initiate a switch, a portion of the packaging may be illuminated by lights shining on the surface of opaque packaging, or by a light shining from behind through a translucent screen, to introduce a topic, use, or product capability. Then the toy can appear to comment on this use or capability by means of simulated speech.

Lights can be activated in simple, or complex, patterns. For example, a single switch may control a single light associated with a single graphic display. Alternatively, a single switch may trigger a sequence of lights associated with various graphic displays which may be lit individually, or in groups, to correspond with a story-line or other display of organized information. When such light and graphic displays are combined with sounds synchronized to the visual display, the result can be extremely effective.

In the simplest version of this embodiment, a single audio speaker is provided to reproduce all sounds whether related to the graphic representation on the package, or sounds which appear to emanate from the toy itself. A single integrated circuit chip can control the generation of sound by the packaging and by the toy. The toy may be connected to the packaging by a direct electrical connection, or by a wireless connection. If more capacity, or more sophisticated interaction between the packaging and the toy is desired, separate integrated circuits can be placed in each of the toy and the packaging. These integrated circuits may be preprogrammed to communicate with each other in order to create the illusion or impression that the toy is interacting with some other character, such as a narrator or other character suitable for introducing, or interacting with, the toy. The addition of multiple speakers which can be used to reproduce sounds of separate characters or background noises, from separate locations on or in the packaging, creates enhanced performances or displays which are dynamic, interesting and powerful in their effect on a user.

Toys which are not intended to represent humans may be personified with human speech, or may be provided with their own suitable sound effects. For example, toy animals may make animal sounds, or toy vehicles may make sounds appropriate for the vehicle. A car, for example, may make the sound of starting, idling, spinning wheels, and the like.

In order to perform the intended functions, a source of power must be provided. Typically, this will comprise one or more electrical storage batteries. A single battery, or set of batteries, may be used to power both the packaging and the toy, if the toy requires power in the specific application. Alternatively, separate power sources for the packaging and the toy may be provided.

Turning now to the illustrations, FIGS. 1 through 6 illustrate the combination of a product, in this case a toy, with packaging of the invention. Referring to FIG. 1, packaging 1 is adapted to hold product 3. A source of electrical power 5 powers an integrated circuit 7 which in turn sends signals to audio speaker 9 and visual displays 17. The process for generation of sound or visual displays is initiated by pressure on push button 11 comprising a trigger switch. When the packaging is sitting on a store shelf, or after it is purchased by a consumer, activation of push button 11 initiates the generation of sounds from speaker 9 or visual displays through the various visual displays 17. A single set of sounds corresponding to a single visual display may be produced, or a sequence of sound segments corresponding to various visual displays may be generated. Each visual display 17 is provided with a light source 19 in order to illuminate each visual display. An alternative source of power, such as alternating current from a wall socket, can be accessed using electrical cord 31. In the case of FIG. 1, the power source, integrated circuit and speakers are all located in the packaging 1.

Figure 2:
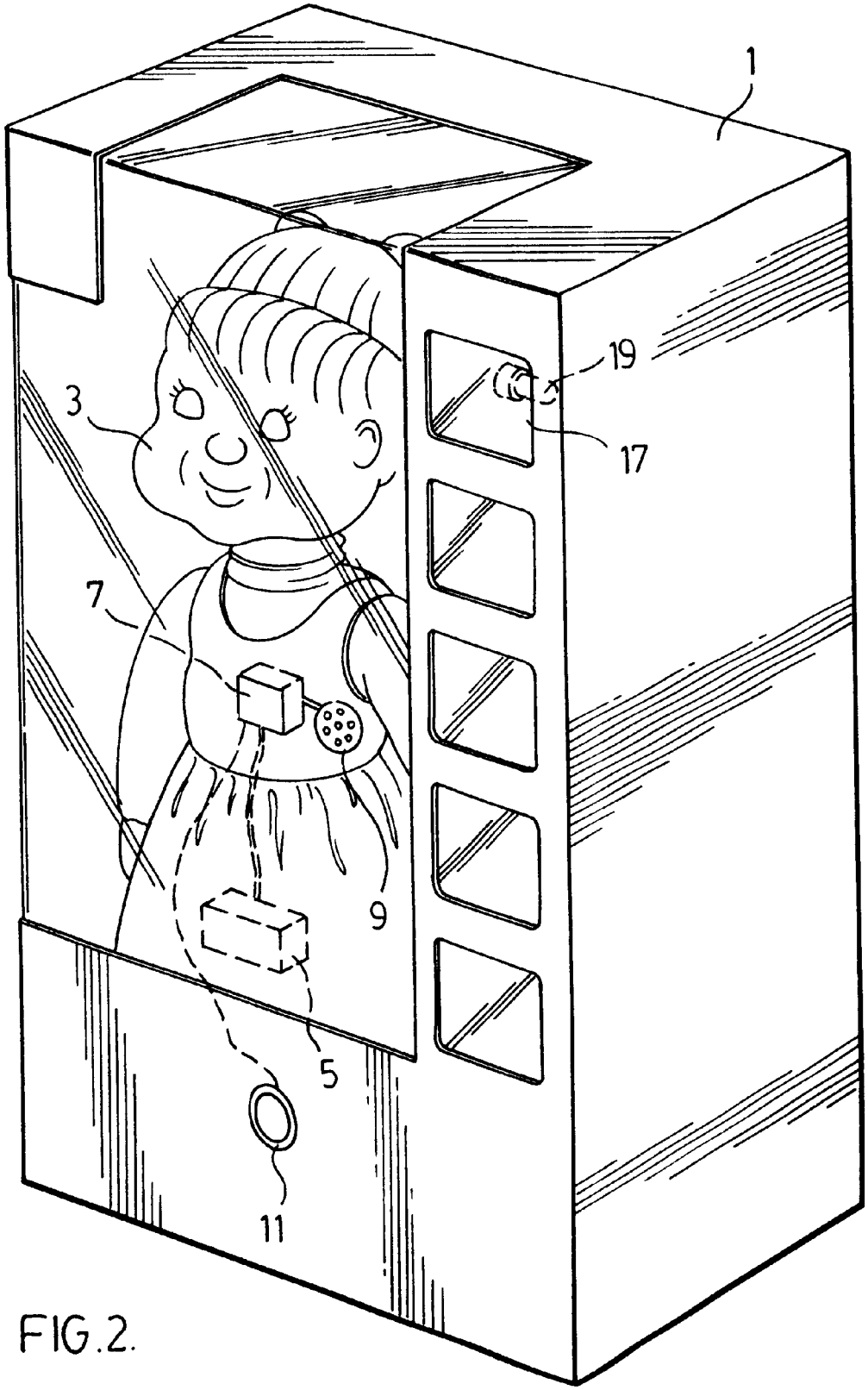

Referring to FIG. 2, the push button 11 comprising a trigger switch is located on the packaging as are the visual displays 17. In this case, however, the product 3 is provided with an integrated circuit 7, power source 5, and speaker 9. Thus, initiation of the trigger switch by pressing push button 11 prompts production of sound from the product and may also initiate illumination of the visual displays 17 under control of the integrated circuit 7 located on the product 3.

Figure 3:
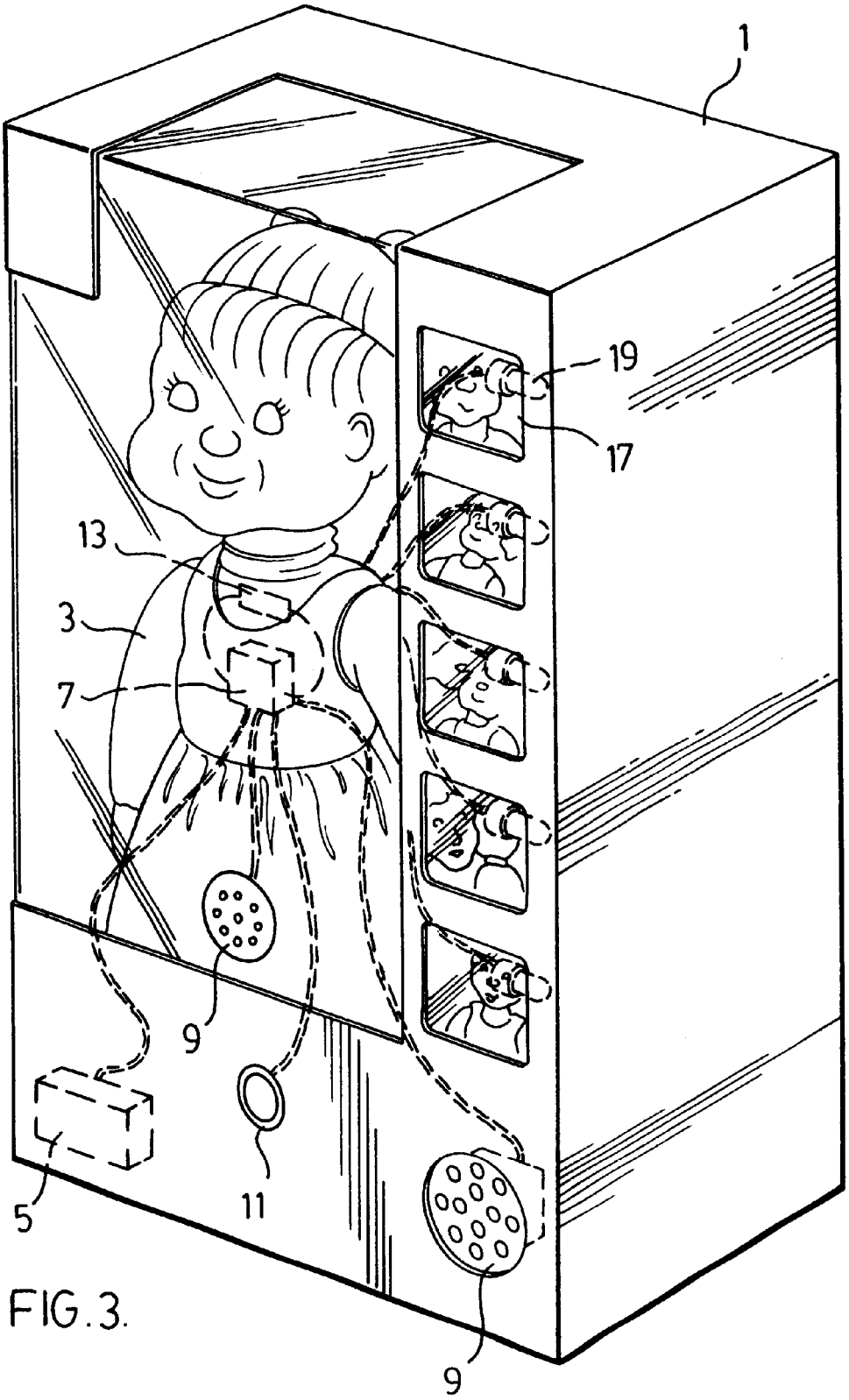

Referring to FIG. 3, there may be some duplication in components of the invention. The packaging illustrated in FIG. 3 comprises the push button 11, power source 5, a speaker 9, and visual displays 17. The product comprises the integrated circuit 7, a second speaker 9, and a separate source of power 13. Typically, power sources 5 and 13 will comprise portable electric storage batteries.

Figure 4:
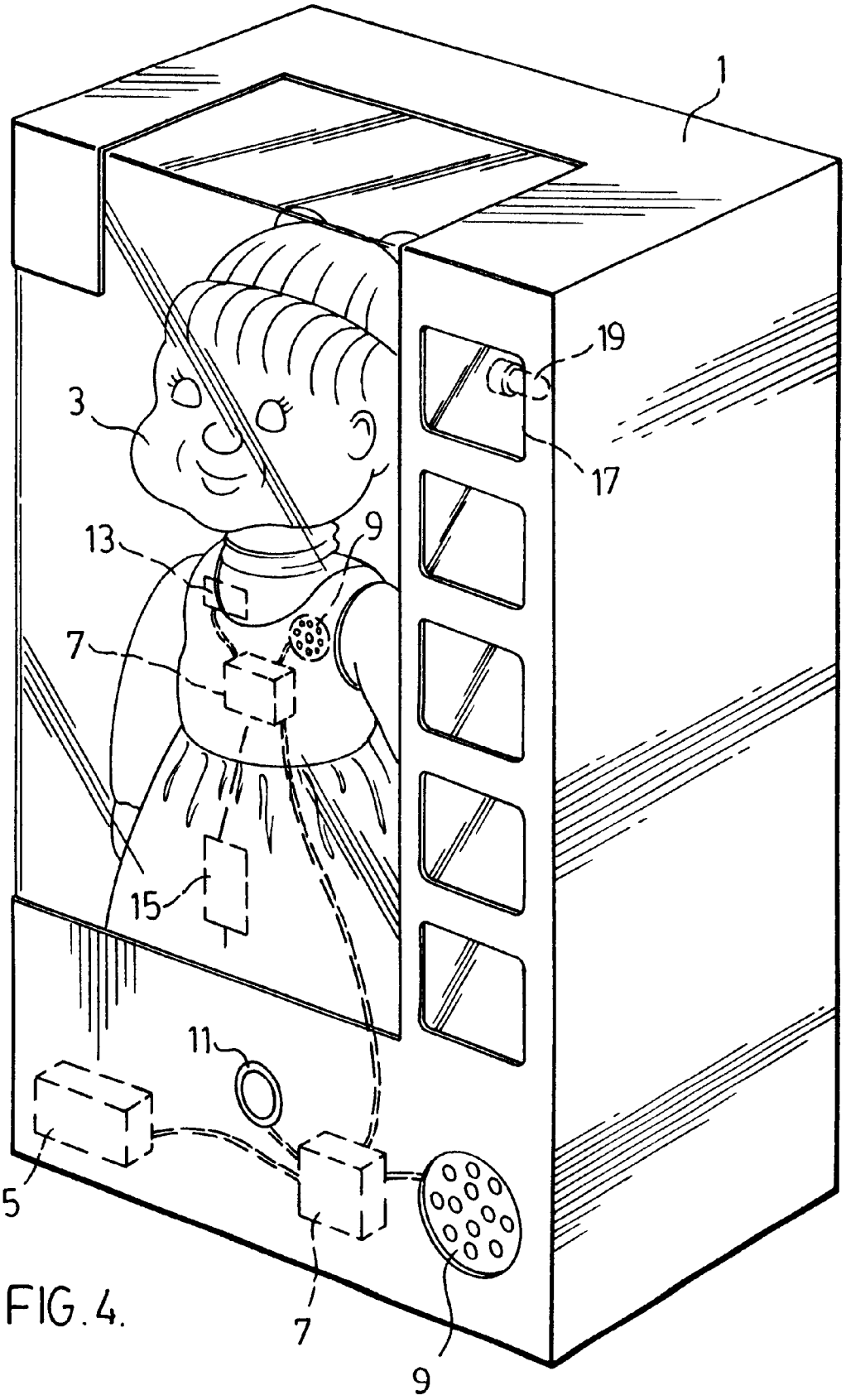

The components illustrated in FIG. 4 are as in FIG. 3, however, the packaging is also provided with its own integrated circuit 7. Thus, each of the product (doll) and packaging can independently generate signals to initiate production of sound or illumination of visual displays. In order that these activities can be coordinated, the integrated circuits 7 of each of the product and packaging are interconnected. In FIG. 4, an electrical motor 15 is also illustrated. Although it is not shown as being connected to any particular components on the doll, electrical motor 15 may be one of a number of such motors adapted to move parts of the doll to create physical movement under control of the integrated circuit 7.

Figure 5:
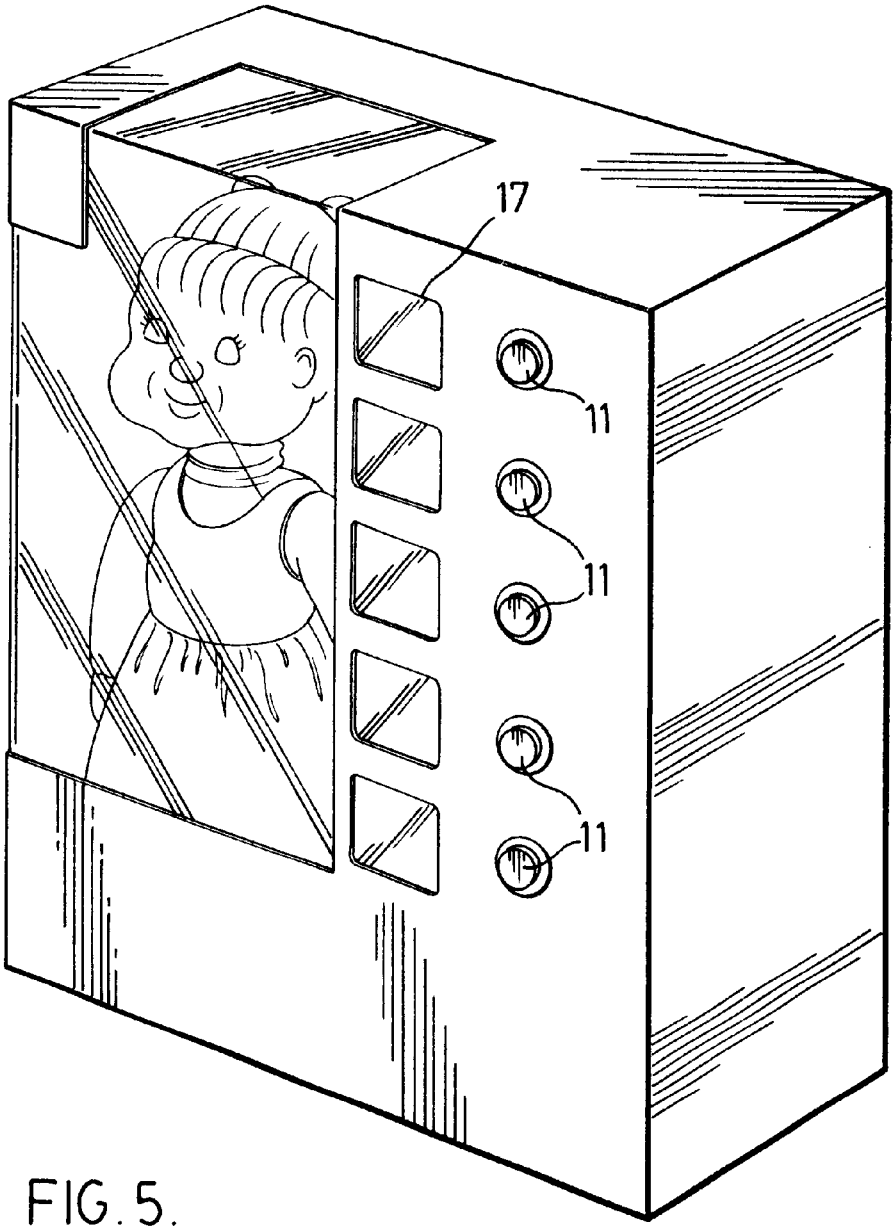

In FIGS. 1 to 4, a single push button 11 with a trigger switch is used to activate production of sound and/or illumination of visual displays. Referring to FIG. 5, individual push buttons 11 are located beside each display panel 17. In order to hear the story respecting the particular panel beside which the push button with an associated switch is located, the switch is activated by the user by pressure on the push button. With appropriate electrical connections, appropriate sound and illumination of a visual display are generated.

Figure 6:
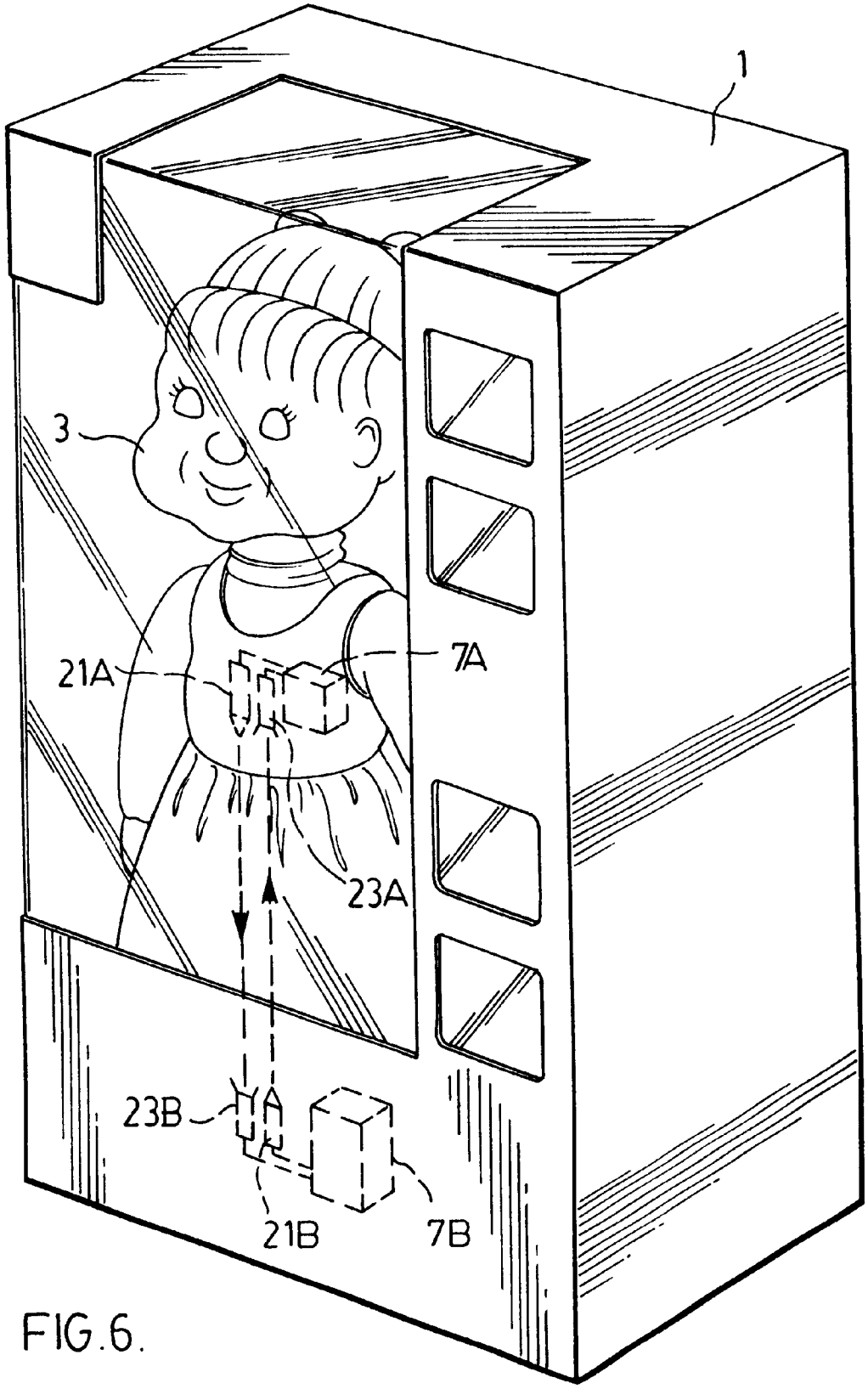

Referring to FIG. 6, a non-physical communication means between the product and the packaging is illustrated. Integrated circuit 7*a* in the product controls electromagnetic transmitter 21*a* and receives signals from electromagnetic receiver 23*a*. Conversely, integrated circuit 7*b* on the packaging controls electromagnetic transmitter 21*b* and is adapted to receive signals from electromagnetic receiver 23*b*. In this way, the integrated circuits of the product and the packaging may communicate with each other without any physical connection. This would be particularly useful in the situation where the product, such as a doll, may be removed from the packaging and then returned to the packaging at a later point. If a physical connection with wires were required, it would be difficult for a child to re-establish a connection between the doll and the packaging. With a wireless system of communication between the doll and the packaging, however, the communication between them can be re-established easily. Although not shown, the embodiment of the invention illustrated in FIG. 6 assumes that each of the product and packaging also has its own power source and may have other duplicative components as well.

Figure 7:
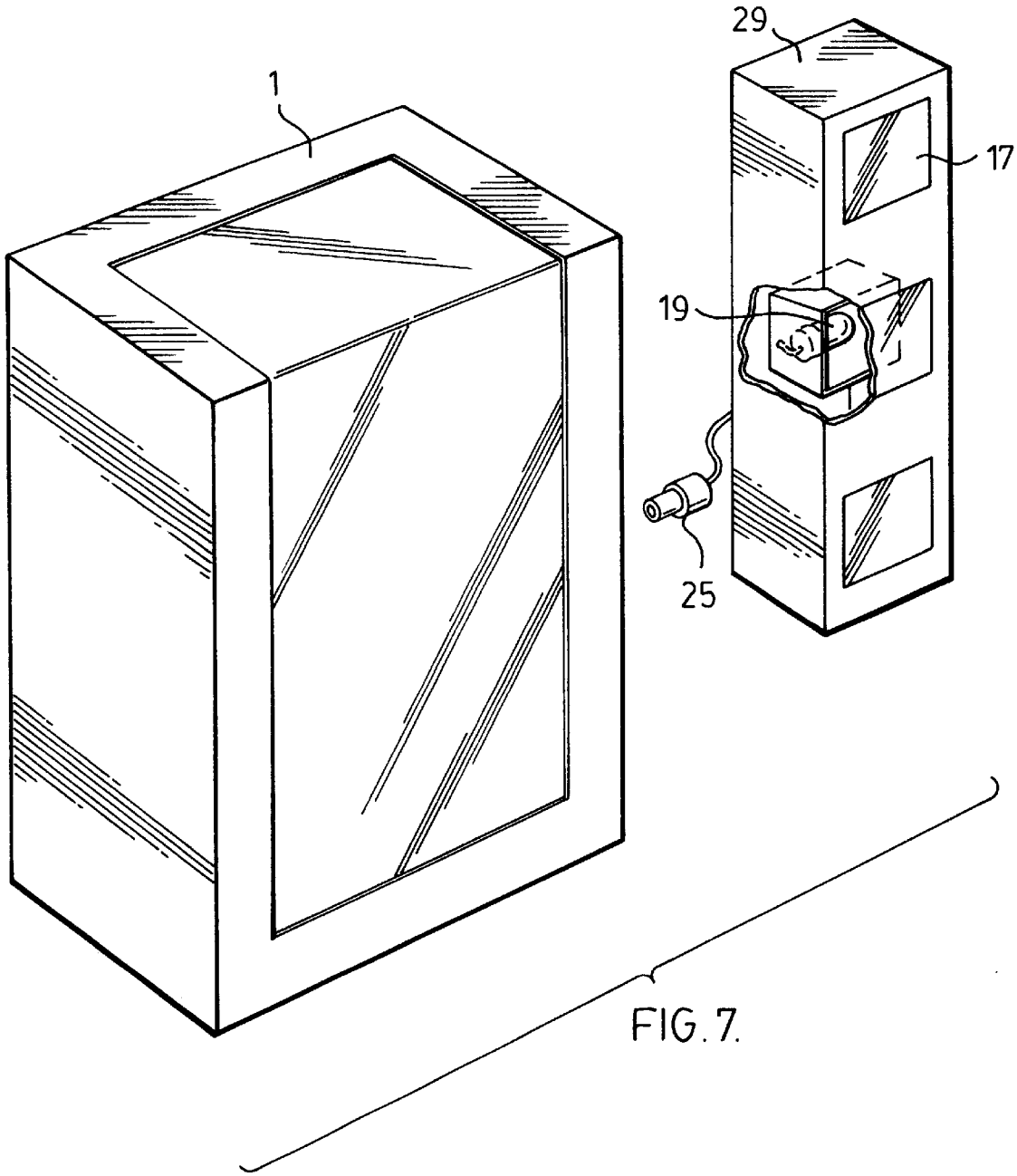
FIG. 7 is a perspective, schematic view of a packaging and packaging peripheral combination.

FIG. 7 illustrates a peripheral visual display bank module 29 which may be connected to packaging 1. The advantage of this arrangement is that different peripheral modules 29 may be connected to one set of packaging using a hard wired electrical connector 25 to draw power from the battery located in the packaging 1. Different modules comprising various stories or explanations corresponding to the product or product/packaging combination may thus be employed. This may be particularly useful in the toy industry where accessories to a main toy are often desired by consumers.

Figure 8:
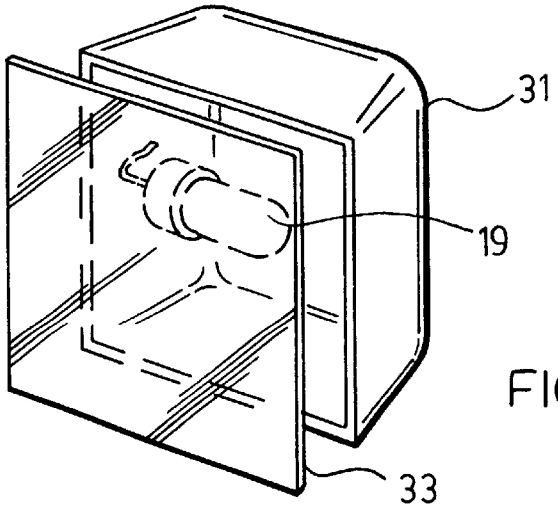
FIG. 8 is an exploded, perspective, schematic view of the construction of a display panel.

FIG. 8 illustrates a typical display unit in exploded view. A light bulb 19 serves to provide illumination. A reflective case 31 reflects light from the light bulb 19 through a translucent sheet 33 to which suitable graphics have been applied.

Figure 9:
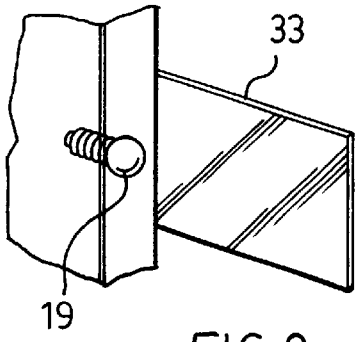
FIG. 9 is an alternative embodiment of a display panel illustrating illumination from the exterior.

Alternatively, referring to FIG. 9, the light bulb which illuminates the display panel 33 may be located outside of the interior of the packaging. Thus, the display panel may be illuminated from the outside by reflected light rather than from the inside by light passing through a translucent panel (as illustrated in FIG. 8).

Figure 10:
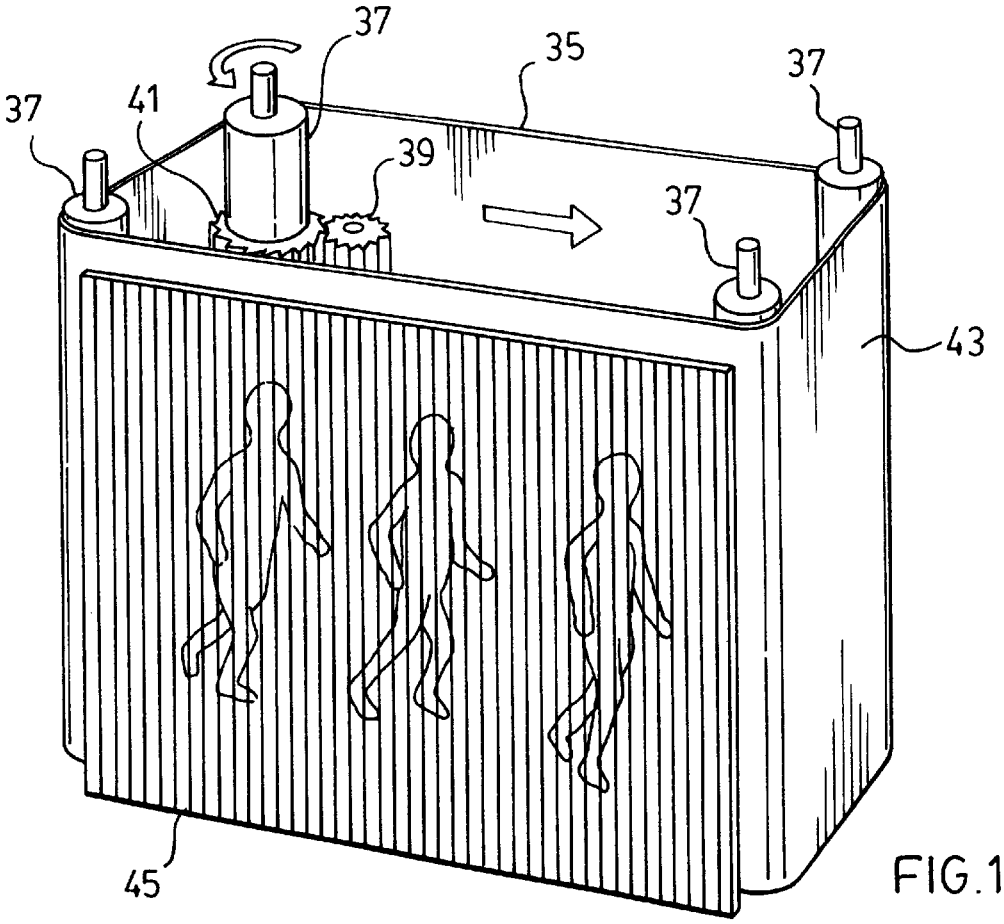
FIG. 10 illustrates a mechanically operated visual display.

FIG. 10 illustrates an alternative means to generate a visual image in a display panel. A roller assembly 35 is mounted within a visual display housing 17 (not shown). The roller assembly comprises a number of rollers 37 and an electrical motor (not shown) which drives a gear 39 which meshes with a corresponding gear 41 located on one of the rollers. Surrounding the rollers is a graphics sheet 43 which may comprise paper, plastic, or some other suitable material. Typically, the graphics sheet forms a continuous loop which can be rotated around the rollers. When images on the graphics sheet are viewed through a refraction screen 45, a sense of movement almost akin to an animated film can be created.

Figure 11:
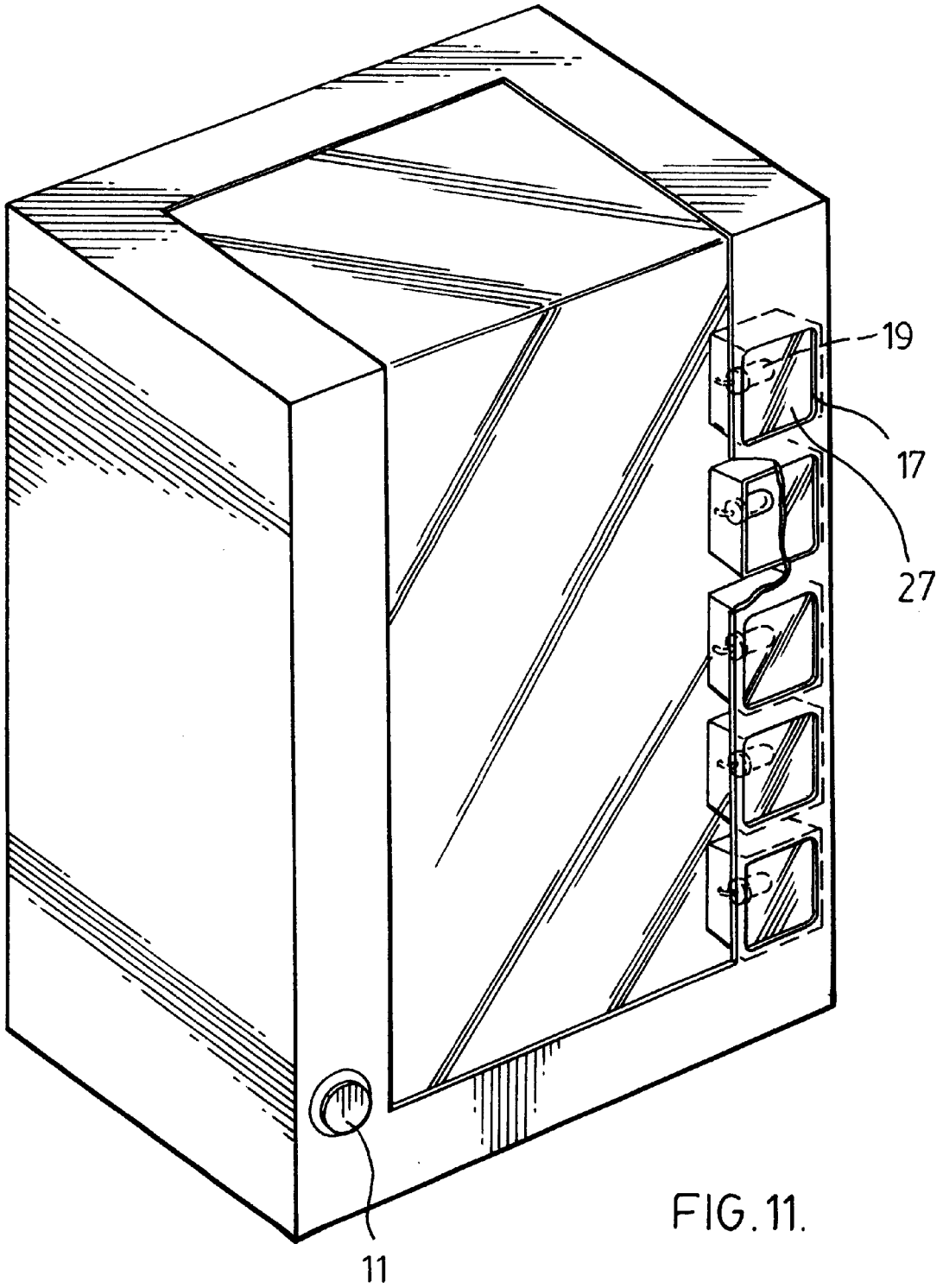
FIG. 11 illustrates a lenticular visual display.

FIG. 11 illustrates an embodiment of the invention in which a lens 27 is placed in front of graphics and illuminated from behind. The use of the lens 27 over a fixed graphic creates an apparent moving image when the graphic is rotated across the field of view of a user of the package. The lens effectively articulates movements by highlighting in sequence individual images on a two-dimensional graphic display. Alternatively, referring to FIG. 8, sheet 33 may comprise a hologram or holographic image so that movement of the package by the user will create different images which may appear to move.

Figure 12:
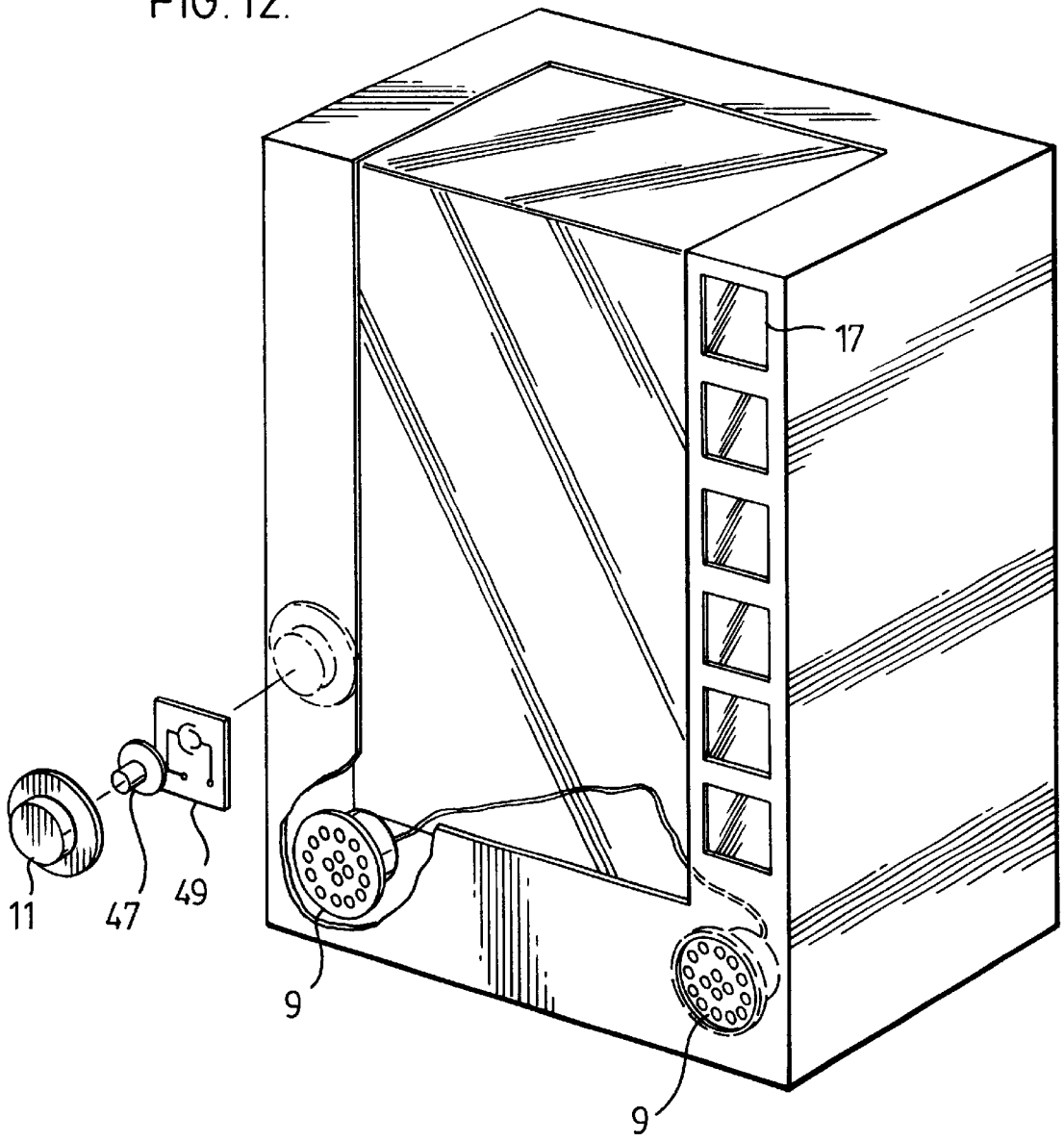
FIG. 12 illustrates an exploded, perspective view of the construction of a trigger switch.

Referring to FIG. 12, an exploded view of one sort of push button and trigger switch is illustrated. The push button 11 actuates a rubber key 47 which presses a trigger circuit board 49 in order to generate a signal which is transmitted to the integrated circuit.

Figure 13:
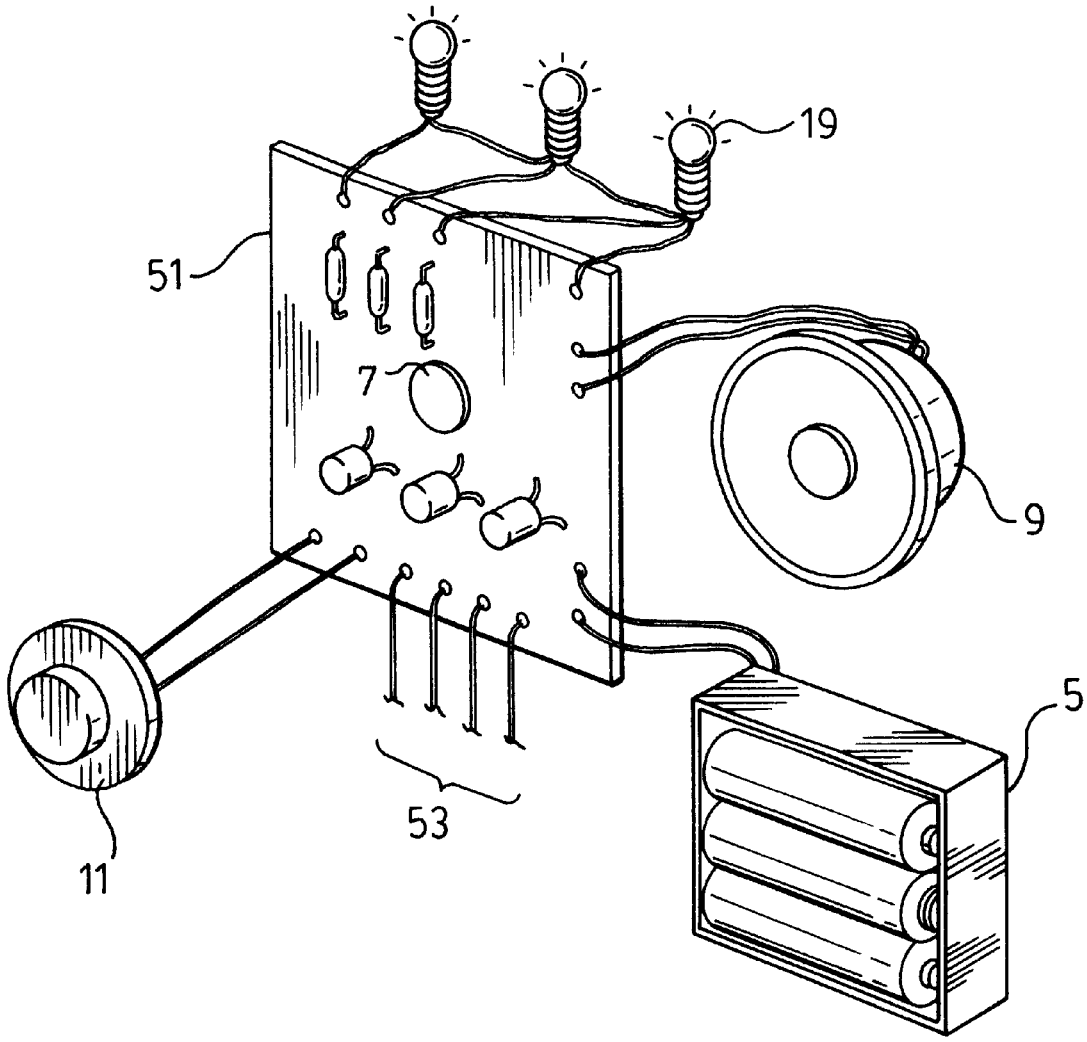
FIG. 13 illustrates a schematic, perspective view of the connections between various electrical components of the invention.

Referring to FIG. 13, a schematic view of various components of the packaging, or product, or combination thereof, are illustrated. Push button 11 is connected to a circuit board 51. The circuit board draws power from the power source or array of batteries 5 to power the integrated circuit 7 and other functions of the product, packaging, or combination thereof, including the light bulbs 19, speaker 9, and other components 53 (not illustrated specifically).

Figure 14:
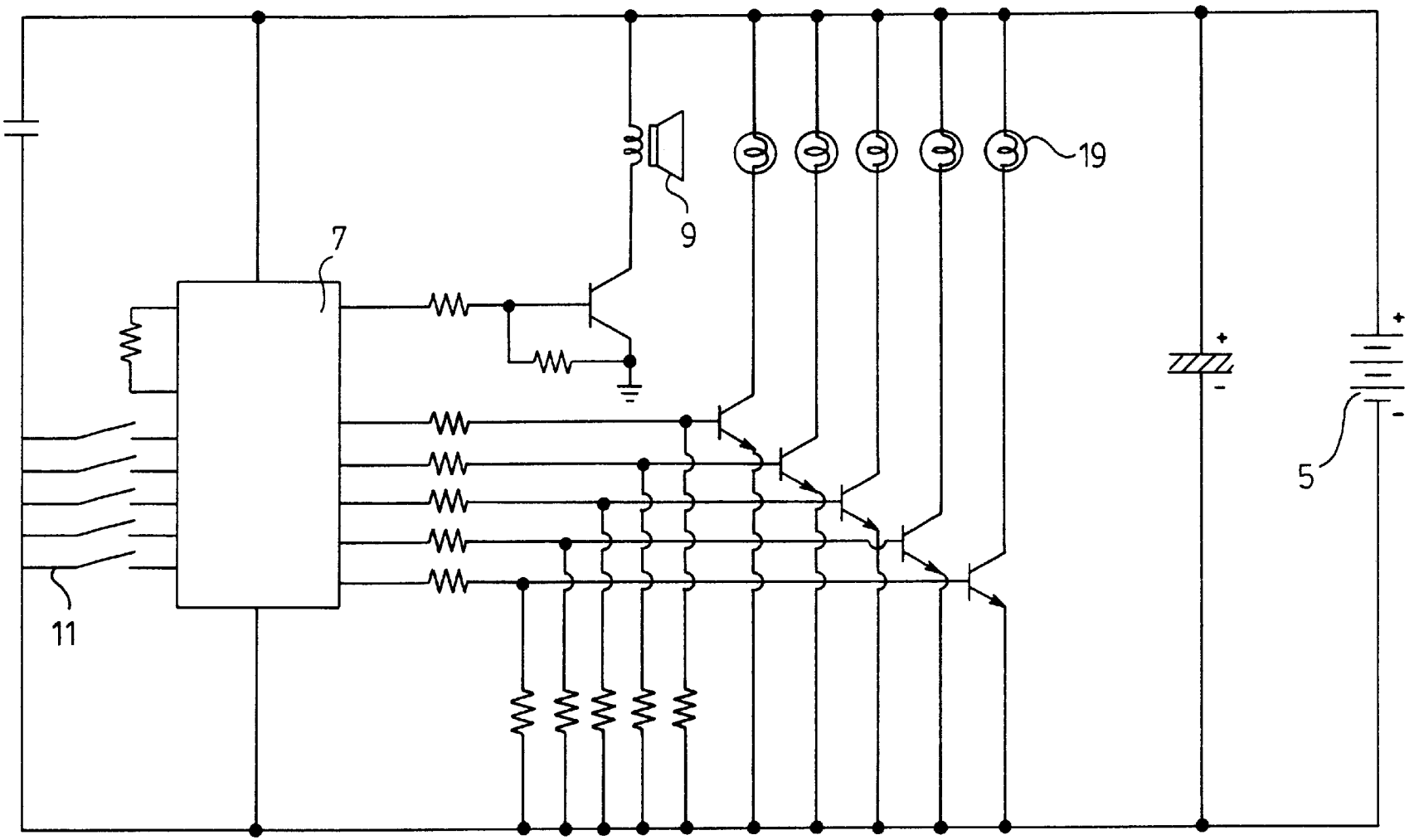
FIG. 14 is a circuit diagram illustrating a typical arrangement of electrical components of the invention.

FIG. 14 illustrates a typical circuit diagram for the product and packaging invention.

Figure 15:
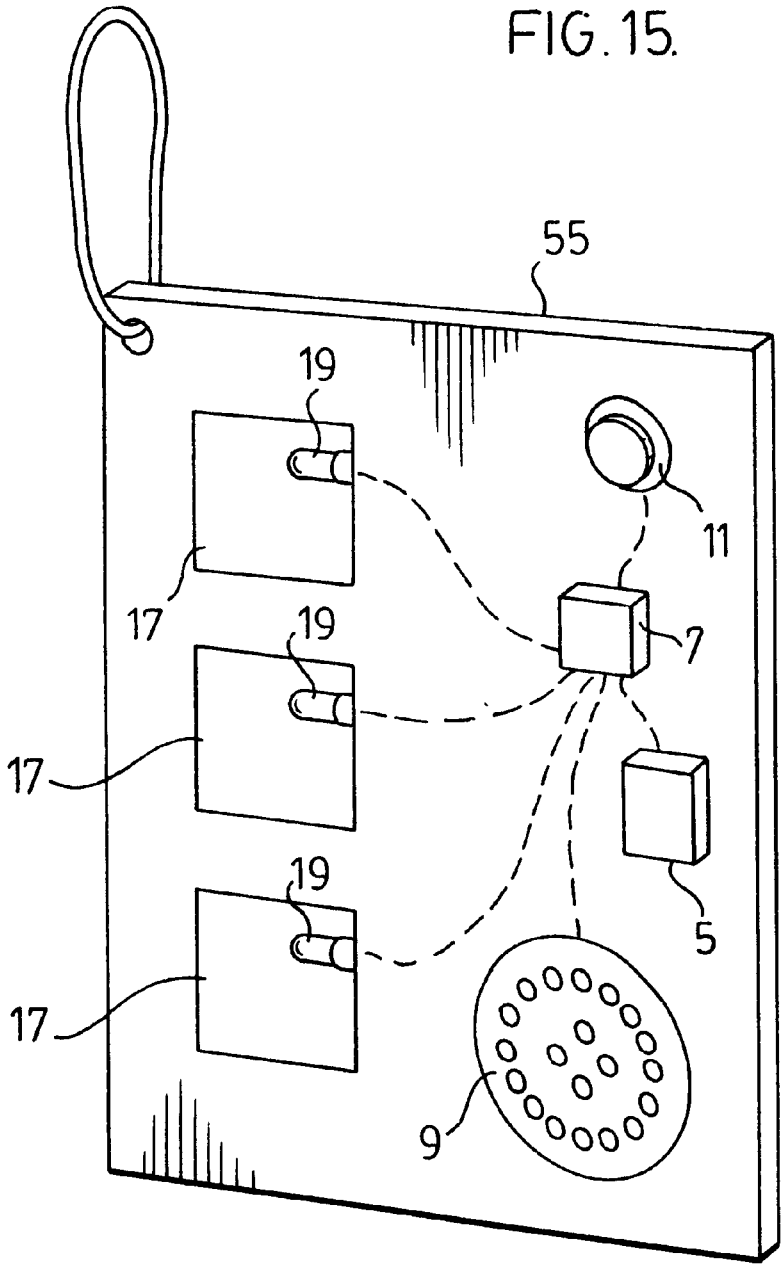
FIG. 15 is a schematic, perspective view of a point of purchase or point of sale embodiment of the invention.

FIG. 15 illustrates an aspect of the invention in which the packaging is reduced to a piece of point of sale material, such as a hang tag or card insert. This thin card 55 is provided with its own power source 5, integrated circuit 7, display panels 17, light sources 19, speaker 9, and activation button 11. As with various other embodiments of the invention previously discussed, the integrated circuit controls the generation of sound and the illumination of the visual displays, and may cause the visual displays to become illuminated singly, in sequence, or in various combinations to better illustrate the dynamics of a story, or the features or functions of a product when the invention is employed as a sort of product manual.

Although this invention has been illustrated most fully with reference to packaging for toys, and the combination of packaging and a toy, it will be apparent that the invention has general application to packaging and display materials for products.

What is claimed is:

1. Product and packaging for demonstrative use of the product, comprising:

(a) packaging adapted to hold a product;

(b) a source of electrical power located in the product;

(c) an integrated circuit chip comprising pre-programmed sound segments relevant to the product;

(d) sound reproduction means to reproduce sound under the control of the integrated circuit chip;

(e) switch means located on the packaging to control the flow of electrical power to the integrated circuit chip; and such that when a user activates the switch means, pre-programmed sound segments suitable to demonstrate the use or capabilities of the product are generated.

2. The product and packaging of claim 1, wherein the product is a toy.

3. The product and packaging of claim 1, wherein the source of electrical power comprises an electrical storage battery.

4. The product and packaging of claim 1, wherein the integrated circuit chip is located in the packaging.

5. The product and packaging of claim 1, wherein the integrated circuit chip is located in the product.

6. The product and packaging of claim 1, wherein the pre-programmed sound segments comprise human speech.

7. The product and packaging of claim 1, wherein the pre-programmed sound segments comprise sound effects.

8. The product and packaging of claim 1, wherein the means to reproduce sound comprises an audio speaker.

9. The product and packaging of claim 8, wherein the audio speaker is located in the packaging.

10. The product and packaging of claim 8, wherein the audio speaker is located in the product.

11. The product and packaging of claim 1, wherein the means to reproduce sound comprises multiple audio speakers.

12. The product and packaging of claim 11, wherein at least one audio speaker is associated with the packaging, and at least one other audio speaker is associated with the product.

13. The product and packaging of claim 1, wherein the switch means is adapted to be activated by a user's touch.

14. The product and packaging of claim 13, wherein the switch means is associated with a graphic representation of a use or capability of the product.

15. The product and packaging of claim 14, further comprising illumination means to illuminate the graphic representation when the switch means is activated.

16. The product and packaging of claim 1, wherein the switch means comprises multiple switches corresponding to multiple features of the product's use or capabilities.

17. The product and packaging of claim 16, further comprising multiple graphic representations of uses or capabilities of the product associated with the multiple switches.

18. The product and packaging of claim 1, further comprising illumination means wherein the switch means is further adapted to initiate illumination of multiple graphic representations of uses or capabilities of the product, by said illumination means.

19. Packaging for a toy having a source of electrical power, comprising:

(a) means to hold and display the toy;

(b) an integrated circuit chip comprising pre-programmed sound segments relevant to the toy;

(c) an audio speaker to reproduce said sound segments under the control of the integrated circuit chip;

(d) means for electrically connecting the source of electrical power in the toy to the integrated circuit chip; and (e) switch means located on the packaging to initiate the flow of electrical power to the integrated circuit chip;

such that when a user activates the switch means, the sound segments are audibly reproduced.

20. The packaging of claim 19, wherein the switch means is associated with a graphic representation of a use or capability of the toy.

21. The packaging of claim 19, wherein the switch means is associated with multiple graphic representations of uses or capabilities of the toy.

22. The packaging of claim 19, wherein the switch means comprises multiple switches, each switch associated with a graphic representation of a use or capability of the toy.

23. The packaging of claim 20, further comprising illumination means, wherein the switch means is further adapted to initiate illumination of the graphic representation, by said illumination means.

24. The packaging of claim 21, further comprising illumination means, wherein the switch means is further adapted to initiate serial illumination of the multiple graphic representations, by said illumination means.

25. The packaging of claim 22, further comprising illumination means, wherein each switch is further adapted to initiate illumination of its associated graphic representation by said illumination means.

26. A packaging and toy combination comprising:

(a) means associated with the packaging to hold and display the toy;

(b) electrical power means to provide electrical power to the toy and the packaging, the electrical power means located in the toy;

(c) integrated circuit means comprising pre-programmed sound segments;

(d) sound reproduction means associated with each of the packaging and the toy under the control of the integrated circuit means;

(e) switch means located on the packaging to initiate the flow of electrical power to the integrated circuit chip means;

such that when a user activates the switch means, the sound segments are reproduced sequentially by the sound reproduction means of each of the packaging and the toy.

27. The packaging and toy combination of claim 26, wherein the switch means is associated with a graphic representation of a use or capability of the toy.

28. The packaging and toy combination of claim 27, further comprising illumination means, wherein the switch means is further adapted to initiate illumination of the graphic representation, by said illumination means.

29. The packaging and toy combination of claim 26, wherein the switch means comprises multiple switches, each switch associated with a graphic representation of a use or capability of the toy.

30. The packaging and toy combination of claim 29, further comprising illumination means, wherein each switch is further adapted to initiate illumination of its associated graphic representation, by said illumination means.

31. The packaging and toy combination of claim 26, wherein the switch means is associated with multiple graphic representations of uses or capabilities of the toy.

32. The packaging and toy combination of claim 31, further comprising illumination means, wherein the switch means is further adapted to initiate serial illumination of the multiple graphic representations, by said illumination means.

33. A packaging and product combination comprising:

(a) electrical power means to provide electrical power to the product and the packaging, the electrical power means located in the product;

(b) integrated circuit means programmed to control a visual display associated with the packaging;

(c) means for providing power from the electrical power means in the product to the integrated circuit means in the packaging; and (d) switch means adapted to trigger the integrated circuit means to perform visual display commands to create the visual display associated with the packaging.

34. The packaging and product combination of claim 33, wherein the product comprises the integrated circuit means and the switch means, and further comprises communication means to carry signals from the integrated circuit means to the packaging.

35. The packaging and product combination of claim 34, wherein the communication means comprises a physical electrical connection.

36. The packaging and product combination of claim 34, wherein the communication means comprises a wireless electromagnetic transmitter, and wherein the packaging further comprises receiver means to receive signals from said transmitter.

37. Product and packaging for demonstrative use of the product, comprising:

(a) packaging adapted to hold the product;

(b) a source of electrical power located in the product;

(c) an integrated circuit chip comprising pre-programmed demonstrations relevant to the product, the integrated circuit chip located in the packaging;

(d) a first demonstration means located in the product to reproduce a demonstration under the control of the integrated circuit chip;

(e) switch means located on the packaging to control the flow of electrical power to the integrated circuit chip; and (f) means for electrically connecting the product to the package for supplying power from the product to the packaging.

38. The product and packaging of claim 37, further comprising a second demonstration means located in the packaging to reproduce a demonstration under the control of the integrated circuit chip.

39. The product and packaging of claim 38, wherein the first and second demonstration means are choreographed.

40. The product and packaging of claim 38, wherein the first demonstration means is an audio system.

41. The product and packaging of claim 40, wherein the second demonstration means is an audio system.

42. The product and packaging of claim 38, wherein the first demonstration means is a visual system.

43. The product and packaging of claim 42, wherein the second demonstration means is a visual system.

44. The product and packaging of claim 38, wherein the first demonstration means is a predetermined series of movements.

45. The product and packaging of claim 44, wherein the second demonstration means is an audio or visual system.

46. The product and packaging of claim 45, wherein the predetermined series of movements are choreographed to the audio or visual demonstration.

47. Product and packaging for demonstrative use of the product, comprising:

(a) packaging adapted to hold the product;

(b) a source of electrical power located in the product;

(c) a first integrated circuit chip comprising pre-programmed demonstrations relevant to the product, the integrated circuit chip located in the packaging;

(d) a first demonstration means located in the packaging to reproduce a demonstration under the control of the integrated circuit chip;

(e) switch means located on the packaging to control the flow of electrical power to the integrated circuit chip; and (f) means for electrically connecting the product to the package for supplying power from the product to the packaging.

48. The product and packaging of claim 47, further comprising a second demonstration means located in the product and a second integrated circuit chip located in the product having pre-programmed demonstrations relevant to the product for controlling the second demonstration means.

* * * * *

UNITED STATES PATENT AND TRADEMARK OFFICE

CERTIFICATE OF CORRECTION

PATENT NO. : 6,749,437 B2
DATED : June 15, 2004
INVENTOR(S) : Albert Wai Tai Chan It is certified that error appears in the above-identified patent and that said Letters Patent is hereby corrected as shown below:

Column 10,
Line 56, insert -- (f) means for electrically connecting the product to the package for supplying power from the product to the packaging, --

Signed and Sealed this

Fourteenth Day of September, 2004

JON W. DUDAS
*Director of the United States Patent and Trademark Office*